US012767307B2

(12) United States Patent
Goetze et al.

(10) Patent No.: US 12,767,307 B2
(45) Date of Patent: Oct. 20, 2026

(54) OUTBOARD MOTOR WITH SHAFT HEAD AND BATTERY HOUSING

(71) Applicant: Torqeedo GmbH, Wessling (DE)

(72) Inventors: Cedric Goetze, Wessling (DE); Moritz Mueller, Wessling (DE)

(73) Assignee: Torqeedo GmbH, Wessling (DE)

( * ) Notice: Subject to any disclaimer, the term of this patent is extended or adjusted under 35 U.S.C. 154(b) by 163 days.

(21) Appl. No.: 18/937,626

(22) Filed: Nov. 5, 2024

(65) Prior Publication Data

US 2025/0145268 A1 May 8, 2025

(30) Foreign Application Priority Data

Nov. 6, 2023 (DE) ..... 102023130680.4

(51) Int. Cl.
*B63H 20/32* (2006.01)
*B63H 21/17* (2006.01)

(52) U.S. Cl.
CPC ..... *B63H 20/32* (2013.01); *B63H 21/17* (2013.01)

(58) Field of Classification Search
CPC ..... B63H 20/32; B63H 20/007; B63H 20/00; B63H 21/17
See application file for complete search history.

(56) References Cited

U.S. PATENT DOCUMENTS

| | | | | |
|---|---|---|---|---|
| 10,946,939 | B1 | 3/2021 | Montague et al. | |
| 12,384,504 | B2 * | 8/2025 | Jaszewski | B63H 20/007 |
| 2011/0244740 | A1 | 10/2011 | Daikoku et al. | |

FOREIGN PATENT DOCUMENTS

| | | | | |
|---|---|---|---|---|
| DE | 102018120094 | A1 | 2/2020 | |
| EP | 4219290 | A1 | 8/2023 | |
| JP | 2005-162054 | A | 6/2005 | |
| JP | 2005162055 | A * | 6/2005 | B63H 20/007 |
| JP | 2011-213241 | A | 10/2011 | |
| WO | 2023/274708 | A1 | 1/2023 | |

OTHER PUBLICATIONS

Extended European Search Report and Search Opinion received for European Application No. 24211247.2, mailed on Apr. 9, 2025, 5 pages.
Search Report received for German Application No. 102023130680.4, mailed on Oct. 23, 2024, 3 pages. (Original Copy only).

* cited by examiner

*Primary Examiner* — Arfan Y. Sinaki
(74) *Attorney, Agent, or Firm* — ArentFox Schiff LLP

(57) ABSTRACT

An outboard motor is provided having a shaft head defining a longitudinal axis; and a housing of a battery that is detachably connectable to the shaft head. The shaft head has a plurality of guides configured to connect the housing of the battery. Moreover, guide elements extend at an end region of the housing and are arranged such that the guide elements engage with a respective guide of the plurality of guides when connecting the housing to the shaft head. In this aspect, the plurality of guides and the guide elements are configured such that the housing is first pivoted on the shaft head and subsequently pushed relative to the shaft head.

20 Claims, 9 Drawing Sheets

OUTBOARD MOTOR WITH SHAFT HEAD AND BATTERY HOUSING

CROSS REFERENCE TO RELATED APPLICATIONS

The current application claims priority to German Application No. 10 2023 130 680.4, filed Nov. 6, 2023, the contents of which are hereby incorporated by reference.

TECHNICAL FIELD

The present disclosure relates to an outboard motor, in particular a connection system for a shaft head and a housing of a battery of an outboard motor for an electrically driven boat.

BACKGROUND

In the case of electrically driven boats or boats, use is frequently made of outboard motors which are fastened to the mirror or stern of the boat. In this case, the shaft, on which a shaft head is arranged at one longitudinal end and a propeller is arranged at the opposite longitudinal end, is usually firstly fastened to the mirror of the boat by means of toggle screws. Subsequently, a pin and a housing of a battery are then connected to the shaft head.

In this way, the assembly or disassembly of the outboard motor can be facilitated and components of the outboard motor can likewise be removed without this requiring complete disassembly of the outboard motor. Thus, for example, the pin and the housing of a battery can be removed in order to prevent control of the drive by unauthorized third parties or to allow external charging and storage of the battery.

However, current solutions require that the pin and the motor are connected to the housing of a battery via individual plug-in connections, wherein, for a watertight connection, it is additionally necessary to tighten union nuts on the individual plug-in connections. In addition, for the mechanical fixing of the housing of a battery, a latch is provided which is inserted through the housing of a battery and the shaft head in order thus to provide latching and secure fastening of the housing of a battery to the shaft head. The connection of the battery thus requires a multiplicity of steps which have to be carried out manually and, for example, must be carried out again in the event of a battery change.

The electrically conductive connection to a battery can furthermore be prone to faults. This is because, in order to avoid damage, tensile stresses and crimping on the respective cables should in principle be prevented. Likewise, the pins of the electrical plug-in connection should be aligned precisely with respect to one another in order to avoid possible bending of the pins, in particular in the event of an excessively high force used. Equally, the union nuts should just be fitted in order to prevent the corresponding thread from not being damaged during tightening. As a result, the assembly can be cumbersome and furthermore require both-handed assistance by the operator.

SUMMARY OF THE INVENTION

In view of the foregoing, it is an object of the present disclosure to provide an improved and, in particular, simplified connection for an outboard motor.

The object is achieved by an outboard motor having the features of claim 1. Advantageous developments result from the dependent claims, the description and the figures.

Accordingly, an outboard motor for a boat is proposed, comprising a shaft head defining a longitudinal axis and a housing of a battery detachably connectable to the shaft head. The shaft head in this case has guides for connecting the housing of the battery. Guide elements extend at an end region of the housing, wherein the guide elements are arranged such that they are in engagement with a respective guide when connecting the housing to the shaft head. According to the present disclosure, it is further provided that the guides and the guide elements are configured such that the housing for connecting to the shaft head is first pivoted on the shaft head and subsequently pushed relative to the shaft head, wherein the housing and the shaft head each have an electrical connection element which are arranged such that they are electrically conductively connected to one another by the pushing movement when connecting the housing to the shaft head.

As a result of the initial pivoting movement of the housing, the battery can first be connected to the shaft head in a simple manner, for example by inserting the guide elements and a successive rotation or rotation of the housing. The subsequent pushing movement additionally has the particular advantage that a reliable electrically conductive connection of the components of the outboard motor can be produced when connecting the housing. In this case, the weight of the rechargeable battery or of the battery advantageously does not have to be held manually. This is because the battery can then be simply pushed during the pushing movement after the initial connection. In this way, in addition, in particular the connection elements can be electrically conductively connected to one another by a simple plug-in connection. The plug-in connection in this case takes place virtually automatically when connecting the housing to the shaft head. Correspondingly, a cableless connection can be provided and a cumbersome screwing of, for example, union nuts can be dispensed with.

The housing of the battery is furthermore to be understood as an outer housing, wherein one or more battery units are arranged in the interior of the housing. The battery or the battery unit is correspondingly connected to the shaft head by the housing and in this case is not received by a further container or housing. In this way, the housing is in direct contact with the surroundings, with the result that the housing forms a protection for the battery unit against direct external influences.

Preferably, the connection elements are each arranged on the end side and such that they are spaced apart from one another during the pivoting movement and are aligned concentrically with respect to one another during the pushing movement. A plug-in connection can be further facilitated by the concentric alignment. The initial spacing apart of the connection elements in this case ensures that the connection elements do not touch one another during the initial connection of the housing, with the result that possible distortions of the corresponding contact elements, which would occur for example in the case of a merely rotatable connection of a battery relative to the shaft head without successive linear displacement, can be avoided.

In particular, the respective end side of the housing and of the shaft head can each have a single electrical connection element which provides an electrically conductive connection for a pin and motor connectable to the shaft head. Thus, separate connections can be dispensed with and a more compact design can be provided. The contact pins required for the respective electrically conductive connection can in this case be provided in corresponding, insulated regions on the respective connection element. Preferably, the connection elements are in this case designed as a socket or plug.

Owing to the fact that the connection elements are preferably located on the respective end sides, the connection elements can additionally be better protected from external influences, mechanically and/or fluidically. Preferably, the shaft head is in this case enclosed by a corresponding section of the housing and is at least partially received in the housing, wherein in particular the end sides are surrounded or flanked by the housing. In this way, the connection elements can be laminated, with the result that inadvertent contact can be avoided. Furthermore, improved protection against mechanical influences and improved fluidic sealing can be provided as a result, by direct interaction of the connection elements with the external surroundings being effectively avoided. A seal can be provided, for example, on the corresponding end sides and/or contours, wherein said end sides and/or contours at least surround or enclose the respective connection element. In the connected state of the housing or of the battery, a corresponding linear pressing force can be provided by the pushing movement, which pressing force allows reliable sealing between the connection elements.

Preferably, the guides are arranged on mutually opposite sides of an outer surface of the shaft head and they each define a first connecting section and an adjacent second connecting section for the guide elements, wherein the second connecting section extends perpendicularly to the longitudinal axis and linearly and the first connecting section is inclined with respect to the second connecting section. In this case, the first connecting section can be configured in particular for pivotable mounting of the housing and the second connecting section can be configured in particular for slidable mounting of the housing.

As a result of the configuration of the connecting sections, it is made possible that the guide elements are first in engagement with the first connecting section when connecting the housing to the shaft head by the pivoting movement or rotational movement and can subsequently be guided linearly in the second connecting section. This linear guidance, substantially perpendicularly to the longitudinal axis, advantageously has the effect, inter alia, that improved delimitation of the guide elements and of the corresponding outer housing of the housing of a battery in the longitudinal direction is provided, with the result that the housing can be mounted more reliably on the shaft head. Equally, the inclination of the first connecting section relative to the second connecting section prevents the guide elements from being able to be easily separated from the respective guide in a direction perpendicularly to the longitudinal axis.

In other words, even if the guide elements are moved in the direction of the first connecting section as a result of an unintended pushing movement, a further pivoting movement at an angle to the perpendicular direction is required in order to allow decoupling of the housing from the shaft head. In this way, operation of the housing of the battery is also facilitated during assembly, especially since the housing can be easily coupled to the first connecting section on the shaft head via the guide elements, after which the housing is subsequently held securely by the guide. In this case, removal of the housing can also be facilitated, wherein both the connection and the separation of the housing can advantageously be carried out with a single hand.

The lateral arrangement of the guides is to be understood here as a lateral arrangement, with the result that the guides are not located at the longitudinal ends of the shaft head. They are therefore arranged on a respective side of the shaft head, which preferably runs substantially parallel to the longitudinal axis. As a result of the bilateral arrangement of the guides and preferably likewise of the guide elements, inadvertent inclination of the housing of a battery relative to the shaft head can be prevented and, at the same time, improved mounting can be provided by the linear guide in the second connecting section. Furthermore, the initial connection of the housing of the battery to the shaft head is hereby facilitated, especially since the first connecting section of the guides already predefines a relative alignment of the housing of a battery for the connection to the shaft head. Advantageously, a positioning and alignment of the connection elements relative to one another can be predefined on account of the guide, wherein the second connecting section in this case preferably makes it possible for the connection elements to be moved linearly with respect to one another during connection in order to facilitate the provision of a plug-in connection. When connecting the housing to the shaft head, the connection elements are correspondingly preferably spaced apart from one another during the guide in the first connecting section, while they are preferably aligned concentrically with respect to one another during the guide in the second connecting section, with the result that they are electrically conductively connected to one another as a plug-in connection in the connected state of the battery.

Depending on the configuration of the guides and of the guide elements, the housing of the battery can be correspondingly inserted, pushed or plugged into or onto the shaft head. Preferably, the respective guide is configured as a groove and the respective guide element is configured as a projection, wherein the respective groove preferably has an opening and/or widening at the end region of the first connecting section, which end region is opposite the second connecting section, for insertion of the respective projection.

The groove can correspondingly be provided as a cutout on the shaft head or can be configured as opposite walls extending from an outer surface of the shaft head, wherein the groove is preferably dimensioned in such a way that a respective projection is delimited by the groove. Preferably, the groove is configured in such a way that a respective projection can be moved exclusively linearly, in particular in the second connecting section or during the sliding movement, and a rotation or lateral movement of the projection is prevented.

The projection is preferably of substantially semicircular, block-shaped or pin-shaped design and can correspondingly be dimensioned as a so-called spring for the groove.

The opening can be provided at an end of the first connecting section, which end is opposite an end adjacent to the second connecting section in the guide direction. Preferably, the opening is enlarged or widened here, with the result that the opening is provided at a corresponding end region and, for example, a corresponding cutout is provided at a lower wall section of the groove. The opening and/or the first connecting section can in particular adjoin an end side of the shaft head in order to facilitate the coupling to the guide elements or to the battery housing.

As a result of the opening of the groove, the respective projection can be inserted into the groove in a simple manner and the housing can correspondingly be coupled to the outer surface of the shaft head. A widening can furthermore serve as visual assistance and characterize the region to be inserted, wherein the widening is preferably configured in such a way that, during the insertion into the respective groove, the respective projection is mounted at least on one side by the groove and is introduced into the groove.

Preferably, the first connecting section is of non-linear or curvilinear configuration. As a result, edges which are disadvantageous for the guidance can be avoided and, in particular, a gradual transition to the linear guidance can be provided in the second connecting section, as a result of which the coupling of the housing to the shaft head can be further facilitated. Such a configuration is advantageous in particular in that a transition of the guide elements to the second connecting section in the first connecting section can be assisted by the force of gravity in the case of a corresponding inclination, with the result that the pivoting movement can be facilitated and can be predefined by a transition region of the guide. Furthermore, inadvertent decoupling can hereby be prevented or at least made more difficult.

As described above, the inclination of the first connecting section with respect to the second connecting section is preferably directed upward or towards the end of the longitudinal axis which lies opposite a propeller which is mounted on the shaft. In order to further facilitate the initial coupling between the housing of the battery and the shaft head or the housing and an outer surface of the shaft head, the inclination of the first connecting section with respect to the longitudinal axis preferably lies in the angular range between 10° and 80°, particularly preferably between 20° and 70°. A guidance parallel to the longitudinal axis is thus avoided, as a result of which the handling of the housing and a one-handed connection of the housing of a battery or of the battery to the shaft head are facilitated.

In this case, the preferred angular range can advantageously be combined with a curvilinear configuration of the first connecting section, with the result that both the initial coupling of the guide elements to the respective guide and the transition to the second connecting section can be facilitated.

In order to further facilitate the initial coupling of the guide elements to the respective guide or the transition to the second connecting section, it can likewise be provided that the respective guide element is of rounded or arcuate configuration and/or the guide is rounded in the adjacent region of the first and second connecting sections.

As a result of the corresponding roundings, wherein, for example, a rounded projection and/or rounded walls of a groove can be provided, the guide element can slide along the guide and can be guided in the direction of the second connecting section. As a result of an arcuate shape, which can likewise be configured as a rounded trapezoidal shape, it can furthermore advantageously be achieved that the guide element is guided in the direction of the second connecting section on account of the corresponding rounding in the transition region and is subsequently in engagement with the second connecting section. In this way, the housing can be held by the guide according to a preferred configuration after the initial connection. Particularly preferably, the guides and the guide elements at least partially have a corresponding geometry, with the result that the guide elements are held in a form-fitting manner by the respective guide in the connected state. For example, an end region of the second connecting section, which end region is opposite the first connecting section, can have a corresponding rounding and dimensioning of the abutting guide element, with the result that the guide elements can be held via corresponding contact surfaces and a rotation or rotation of the guide elements and therefore of the housing can be effectively avoided.

Preferably, the respective guide is of L-shaped or J-shaped configuration. For example, the second connecting section can in this case be configured as an extended section of the guide, with the result that a corresponding linear guide path can be provided. The extended linear guide path can be advantageous for example for the corresponding pushing movement or insertion movement of the housing of the battery relative to the shaft head in order to provide successive locking of the housing or contacting of the connection elements. The shorter first connecting section has the advantage that the guide for the initial coupling can be shortened, as a result of which the dimensioning on the shaft head can be reduced and the handling of the housing or of the battery can be facilitated. The upward pivoting of the battery or of the rechargeable battery can also prevent the battery from inadvertently slipping rearward and possibly falling into the water when it is not held. In other words, the upward pivoting requires active actuation or handling of the battery.

The L shape or J shape is preferably configured in such a way that the guide has no or no substantial alignment parallel to the longitudinal axis and the guide is rounded in the adjacent region of the first and second connecting sections. The shorter section, which preferably defines the first connecting section, can have an opening and/or widening at the end region here, as described above. Here, a widened opening, which is correspondingly present not exclusively at an end of the guide arranged in the guide direction but at a corresponding end region, can extend in particular proceeding from a rounding of the guide. Here, a section of the guide can optionally likewise be aligned substantially parallel to the longitudinal axis, but the actual guide can be formed substantially by the rounding and the adjacent opening. In other words, such a section running at least partially parallel to the longitudinal axis can optionally provide a delimitation for the respective guide element. However, the continuation of the guide element is preferably predefined primarily by the rounding and the opening in such a configuration.

The respective guide and the respective guide element can furthermore be configured in such a way that the housing of the battery is connectable to the shaft head exclusively in a single predefined orientation relative to the shaft head. As a result, a faulty connection between the housing and the shaft head can be prevented from being provided, with the result that possible damage to the housing and/or shaft head can be avoided. The connection itself is likewise simplified as a result, especially since the initial coupling is preferably also possible merely in an alignment of the housing relative to the shaft head and the successive guide makes possible an intuitive connection without cognitive or mechanical effort.

The predefined alignment can be defined, for example, on the basis of roundings and/or a dimensioning of the guide elements, on the one hand, and on the basis of a shaping and/or dimensioning of an opening of the guide, for example of the first connecting section, on the other hand, with the result that they jointly provide a poka-yoke connection.

In order to improve the mounting of the housing of the battery on the shaft head, it can be provided that the respective guide and the respective guide element are configured in such a way that, in the connected state of the housing of a battery, the respective guide element forms two line contacts spaced apart from one another or at least one contact surface with the respective guide.

If the guide elements are configured, for example, as a respective projection and the guides are configured as a respective groove, the projection can be dimensioned in such a way that said projection is held by corresponding contact surfaces from opposite sides or walls of the groove. Alternatively or additionally, roundings can also be provided which facilitate the insertion into the groove, for example into the first connecting section and the transition to the second connecting section. As a result, the projection can likewise be in engagement with the groove at two edge regions in the transition region and/or in the second connecting section, for example via two corresponding line contacts. The transition region at the first connecting section and the adjacent second connecting section can be shaped, for example, in such a way that the groove forms a rotation or rotation axis for the projection, wherein the projection engages on opposite walls of the groove during the rotation for linear guidance.

Preferably, the respective guide and the respective guide element are configured in such a way that, in the connected state of the housing, the respective guide element is held in a form-fitting manner by the respective guide. As described above, this can be provided, for example, by corresponding roundings or alternative geometries.

In order to facilitate the coupling of the guide elements to the corresponding guides, two arms spaced apart laterally from one another preferably extend at the end region of the housing, wherein the guide elements are arranged on a respective arm. The arms of the outer housing are in this case preferably configured in such a way that, in the connected state with the housing, the shaft head is at least partially enclosed by the housing or is at least partially received in the housing. In this way, the connection of the housing of the battery to the shaft head can be facilitated, especially since the shaft head itself virtually defines a guide for the correct alignment of the outer housing. As described above, the housing is to be understood in such a way that, in the connected state, it is in direct contact with the surroundings and correspondingly is not received in a further housing. Correspondingly, an outer wall of the housing can be substantially aligned with an outer surface of the shaft head.

The arms can, in this case, in the connected state, extend substantially perpendicularly to the longitudinal direction or longitudinal axis and are preferably provided on corresponding sides of the housing. In particular, the arms can in this case extend on the end side from the housing, preferably at an end region of the housing which lies opposite a handle arranged on the housing.

This exemplary arrangement furthermore has the advantage that a more compact design of the outboard motor can be provided, wherein contacts which are optionally arranged on mutually adjacent end sides of the shaft head and of the housing, such as the connection elements, can at the same time be better and more efficiently protected from mechanical influences and water. In addition, as a result of the advantageous arrangement, a lever action of the housing relative to the shaft head can be shortened or reduced, with the result that, on account of the optimized mounting, a battery with a greater weight and corresponding power can be used. In order to further shorten a potential lever action, in the case of a corresponding configuration of the guide, for example, the second connecting section can extend away in particular perpendicularly from an end side of the outer surface.

Although the guide already allows mounting of the housing of a battery, further mounting can be provided on the basis of the configuration of the shaft head and of the housing, in order, for example, to further assist a battery with relatively high power even in the event of vibrations or an impact. Correspondingly, an outer surface on an end side of the shaft head can have, in cross section, a contour which is inclined relative to the longitudinal axis and which at least partially corresponds to a contour of an adjacent end side of the housing in the connected state.

In other words, the outer surface and the outer housing can virtually form a chamfer on adjacent end sides, which chamfers are geometrically matched to one another, with the result that they directly adjoin one another and make contact with one another. As a result of a part of the housing thus bearing against the outer surface and being supported in a planar manner by said outer surface, forces acting on the housing can be better absorbed and distributed, in particular but preferably not exclusively, in the longitudinal direction. In this way, for example, vibrations on the housing can be absorbed or cushioned, with the result that the forces which act on the guide can be reduced.

As an alternative or further support, the shaft head can likewise have a frame-shaped or plate-shaped holder which extends from its outer surface and which is arranged in such a way that, in the connected state, a base section of the housing is at least partially mounted by the holder.

The holder in this case preferably extends from an end side of the shaft head. As described above for the contours of the respective end sides, an improved force or load distribution in the longitudinal direction can be provided by the holder. The longitudinal direction can in this case be predefined by the shaft and be aligned upward and downward in particular in a Z axis, with the result that forces which can be absorbed substantially perpendicularly to the substantially horizontally extending guides can be absorbed. Thus, for example, disadvantageous effects of an existing torque on the guide and guide elements, for example in the event of an impact of the boat on the water, can be reduced. In this way, batteries with relatively high power and correspondingly additional weight can likewise be connected to the shaft head.

The provision of such a holder additionally has the advantage that the connection of the battery is facilitated by the holder defining a predefined alignment of the housing and making possible a further support of the housing of the battery during the initial connection. Preferably, the holder in this case at least partially has a groove on opposite sides, which groove is arranged and configured in such a way that, in the connected state, it is in engagement with a respective base-side projection of the housing, and the housing is delimited by the holder in at least one direction along the longitudinal axis.

The groove or alternatively configured guide on the holder in this case makes it possible for the connection to be further facilitated and for the housing to be held in a predefined orientation. Preferably, the groove is in this case configured in such a way that the housing of the battery is delimited or supported in both longitudinal directions by the holder. Thus, the groove can, for example, have continuous walls spaced apart from one another in the longitudinal direction, which walls extend substantially in a direction perpendicularly to the longitudinal axis, and wherein the spacing of the walls is dimensioned for receiving the base-side projection.

However, the groove can also be divided and be provided, for example, in sections, wherein exclusively an upper wall is provided on a section and exclusively a lower wall is provided on the adjacent or spaced-apart section in order to provide a delimitation in the longitudinal direction upward (on the shaft-head side) or downward (on the propeller side). Furthermore, it can also be provided that the groove is of single-walled configuration only in one section. For example, the holder can have a groove with exclusively an upper wall directly on the end side of the shaft head and can have a double-walled groove at the opposite end region. In this way, an unintended upward movement of the housing of the battery can advantageously be limited, and the housing can, for example, latch fully, preferably at least partially circumferentially, at the end region and be held in both longitudinal directions.

In order to provide an improved connection between the housing of the battery and the shaft head and to avoid inadvertent decoupling to the greatest possible extent, the shaft head preferably comprises a rotatably mounted lever which is preloaded into a closed position by an energy store. The lever in this case comprises at least one latching element which, in the connected state and in the closed position of the lever, is in engagement with an edge, which extends in the longitudinal direction, on the housing in such a way that the housing is delimited in a direction perpendicular to the longitudinal direction.

The housing can thus be held securely in the second connecting section by the latching element and the corresponding edge, especially since the latching element delimits a linear or horizontal or perpendicular movement of the edge and thus of the housing of the housing of a battery. The edge in this case is preferably held in a form-fitting manner by the latching element. The latching element in this case can be configured in particular in a hook-shaped manner and can be brought into engagement with the edge by a rotation or opening of the lever, a linear pushing movement of the housing toward the shaft head and a subsequent positioning of the lever in the closed position. The energy store in this respect has the effect that inadvertent opening of the lever is avoided and the latching element and the edge are preloaded into the closed, in-engagement arrangement. The energy store, which is preferably configured as a mechanical spring, in this case makes possible a detachable connection, with the result that, when the corresponding energy, in particular the spring force, is bridged, a rotation of the lever is made possible and the housing can be moved away from the shaft head by virtue of the fact that the edge is no longer in engagement with the latching element.

The arrangement of the lever is preferably such that the lever in the closed position is aligned parallel to the base plate or cover side of the housing of the battery and/or an upper side of the shaft head. Preferably, the lever in this case is configured in such a way that the lever is aligned with a longitudinal end of the outer surface of the shaft head. In this way, a particularly advantageous configuration with a compact design can be provided, wherein the risk of inadvertent actuation of the lever can furthermore be reduced.

In order to further facilitate the securing of the housing of the battery on the shaft head during the connecting, the latching element and the edge can have a respective chamfer which are arranged in such a way that, during the connecting of the housing to the shaft head, they adjoin one another at least in sections during the pushing movement, preferably in a second connecting section of the guide, and preload the lever into an open position and/or, in the connected state, are spaced apart from one another in a direction perpendicular to the longitudinal direction.

Correspondingly, the chamfers can slide against one another or be in engagement with one another during a linear movement of the housing relative to the shaft head and can thus bring about a movement of the lever in the longitudinal direction, with the result that the lever is preloaded into an open position in the event of a corresponding action of force on the housing. Conversely, a linear pushing movement, for example in the second connecting section of the guide, can be assisted by the chamfers in the absence of a corresponding action of force or in the event of a reversed action of force and in an open position of the lever. The chamfers and the preloading force provided by the energy store on the lever can in this case facilitate a movement of the housing away from the shaft head for decoupling the battery.

As a result of the spacing apart of the chamfers in the connected state, it can be ensured that, for example, a form-fitting securing is ensured and an unintended preloading into an open position of the lever can be avoided. The chamfers in this case can preferably have a longitudinal edge which adjoin one another in the connected state, wherein the longitudinal edges form the edge of the housing or at least partially form the latching element of the lever.

According to a further, optional embodiment, the lever can have a lever arm which extends in the longitudinal direction from the lever, wherein, in the connected state, the lever arm is in engagement with an end side of the housing and is torque-coupled to the lever.

As a result of the contact with the end side and the torque coupling to the lever, a rotation of the lever thus brings about a rotation of the arm, as a result of which a linear translation of the housing is provided, preferably in a second connecting section of the guide. In this way, a lever action with respect to the housing can be provided which assists the decoupling of the battery from the shaft head. The lever arm of the lever can achieve, for example, a corresponding displacement of the housing away from an end side of the shaft head during the opening or unlatching of the lever by virtue of the corresponding torque bringing about a linear displacement of the housing on account of a corresponding linear displacement of a projection received in a groove. Correspondingly, the configuration of the lever can in particular assist the housing of the battery or the guide elements thereof being pushed out.

A rotation axis can in this case preferably be provided on the lever arm. Correspondingly, the shaft head can furthermore have a cutout, wherein the cutout allows both a reception of the lever arm and a rotation of the lever about the offset rotation axis. It can likewise be provided that an opening of the respective guide or the guide as a whole is arranged with an offset with respect to an end side of the shaft head, wherein the opening can be arranged, for example, on an upper side of the shaft head. As a result, a lever action provided by the lever arm or lever can be further enlarged. As a result of the provided lever arm, the decoupling can correspondingly be facilitated in such a way that a one-handed operation is optionally further assisted even in the case of a battery with relatively high powers. Equally, in this way, the battery can likewise optionally be pushed out or at least facilitated with one hand.

BRIEF DESCRIPTION OF THE DRAWINGS

Exemplary embodiments are explained in more detail by the following description of the figures. In the figures.

DETAILED DESCRIPTION

Exemplary embodiments are described below with reference to the figures. In this case, identical, similar or identically acting elements are provided with identical reference signs in the different figures, and a repeated description of these elements is partially dispensed with in order to avoid redundancies.

Figure 1:
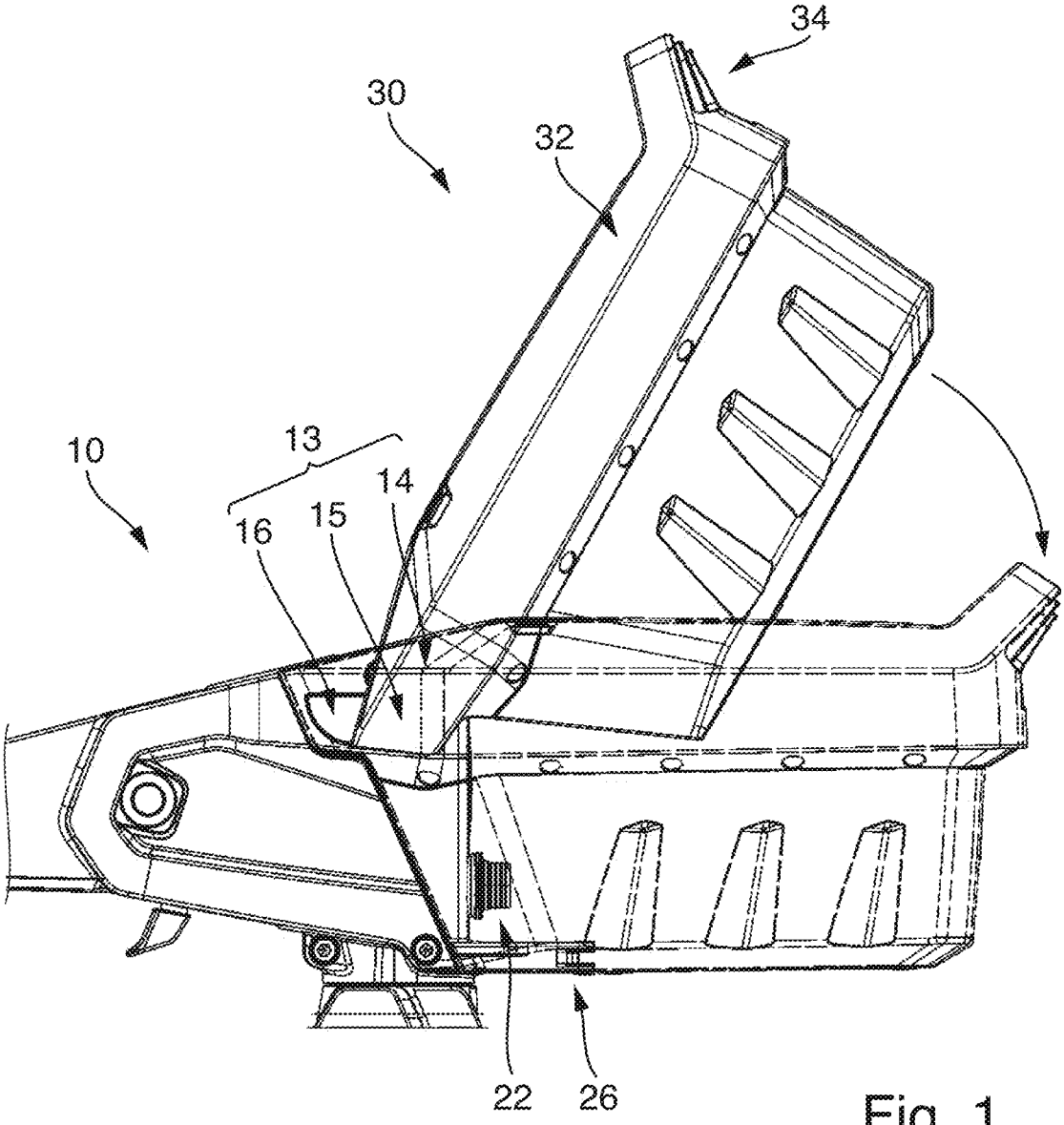
FIG. 1 shows an outboard motor according to the present disclosure having a shaft head and a battery in a preferred embodiment in various connection states in a side view.

FIG. 1 shows an outboard motor having a shaft head 10 and a battery 30, wherein a preferred operation of connecting a housing 32 of the battery 30 to the shaft head 10 is illustrated in a corresponding side view. As shown by the arrows, the housing 32 can firstly be pivoted or rotated on the shaft head 10 or with respect to the shaft head 10 in order to provide an initial connection. Subsequently, the housing 32, which comprises one or more battery units in the housing interior, is pushed toward the shaft head 10, wherein the pushing movement takes place substantially perpendicularly to the longitudinal axis of the shaft or of the shaft head 10. By this pushing movement, the battery 30 or the battery housing 32 is reliably connected to the shaft head 10.

Furthermore, an electrical connection element 22 is provided on an end side of the shaft head 10, said electrical connection element serving for the electrically conductive connection of the shaft head 10 or of a pin (not shown) to the battery 30. It can be seen that the housing 32 does not touch the connection element 22 during the pivoting movement. Accordingly, inadvertent bending of the connection element 22 during the initial connection of the battery 30 to the shaft head 10 can be avoided. Subsequently, the housing 32 is then moved linearly or perpendicularly in the direction of the shaft head 10. By this pushing movement, a corresponding connection element 22 on an end side of the housing 32 can be electrically conductively connected to the connection element 22 of the shaft head 10. In particular, the connection elements 22 can provide a plug-in connection if they are aligned concentrically with respect to one another, for example after the initial pivoting movement. Correspondingly, the connection between the battery 30 and the shaft head 10 or the pin can advantageously be provided virtually automatically by the mechanical connection of the housing 32 to the shaft head 10.

The pivoting movement of the housing 32 or of the battery 30 in this case is made possible by guides 13, wherein the guides 13 are provided on the outer surface of the shaft head 10. The guides 13 in this case comprise a first connection portion 14 and a second connection portion 16, which are configured in the present case as a continuous groove. The corresponding groove is provided on opposite sides of the outer surface or laterally of the shaft head 10.

The first connection portion 14 is configured inclined with respect to the second connection portion 16—in the present embodiment, the two connection portions 14, 16 enclose an angle of approximately 90°. However, the groove is not formed continuously by two opposite walls in the first connection portion 14, but rather has an opening at the end region and an end-side cutout, which thus form a widening of the groove. This opening and widening facilitate the insertion of a corresponding guide element such as a projection of the housing 32 of the battery, as is described below with regard to FIGS. 1 and 2. The opening and widening extend here from a transition region 15, which is formed by the adjacent regions of the first and second connection portions 14, 16. This transition region 15 is likewise rounded, wherein the lower wall of the groove in the first connection portion 14 extends at an angle of between approximately 60° and 80° with respect to the longitudinal direction predefined by the longitudinal axis from the adjacent second connection portion 16. As a result of this rounding and the corresponding angular range, for example, the insertion of a corresponding projection of the housing 32 of the battery 30 can be further facilitated or an improved guidance with respect to the second connection portion 16 can be provided. At the same time, a delimitation for the projection in a direction perpendicularly to the longitudinal axis can thereby be provided when the projection is received in the second connection portion 16, as is provided in the connected state of the battery 30.

Thus, guide elements of the housing 32, in particular in the form of projections, can firstly be inserted into the first connection portion 14 and in this case be aligned at a predefined angle with respect to the longitudinal axis of the shaft head 10, after which the housing 32 is firstly pivoted in the transition region 15 of the first and second connection portions 14, 16. The pivoting movement can be assisted, for example for an operator of the battery 30, by a handle 34 arranged on the housing 32. This pivoting or rotation is furthermore facilitated by the corresponding rounding of this transition region 15 or boundary region and already provides a first hold, especially since the projections are already in engagement with the second connection portion 16.

Subsequently, the housing 32 is then moved linearly in the direction of the shaft head 10 on account of the configuration of the second connection portion 16 until the respective projection strikes against the end region of the second connection portion 16. In this position, the projections are held in a form-fitting manner by the respective groove on account of the corresponding geometries. Based on the linear pushing movement, the connection element 22 arranged on the end side can be connected to a corresponding connection element on an end side of the housing 32 of the battery 30 and in particular can thus form a plug-in connection. The extent of the second connecting section 16 in this case is preferably likewise selected such that the connection elements do not touch one another during the initial connection in the first connecting section 14.

In addition to the guides 13, the battery 30 is furthermore held at least partially by an end side of the shaft head 10 in the connected state by virtue of side regions of the end side being inclined and having, in cross section, a contour which corresponds to a contour of the adjacent contact surface of an end side of the housing 32. Correspondingly, mounting can advantageously be provided by the engagement of the housing 32 on the contour of the end-side outer surface and by the engagement of the projections with the respective guide 13.

An optional holder 26 on the lower region of the shaft head 10 furthermore makes it possible, alternatively or additionally to the contours, for the weight of the battery to continue to be supported and not to be carried exclusively by the guide or by the second connecting section 16. This is described in more detail below with regard to FIG. 2.

Figure 2:
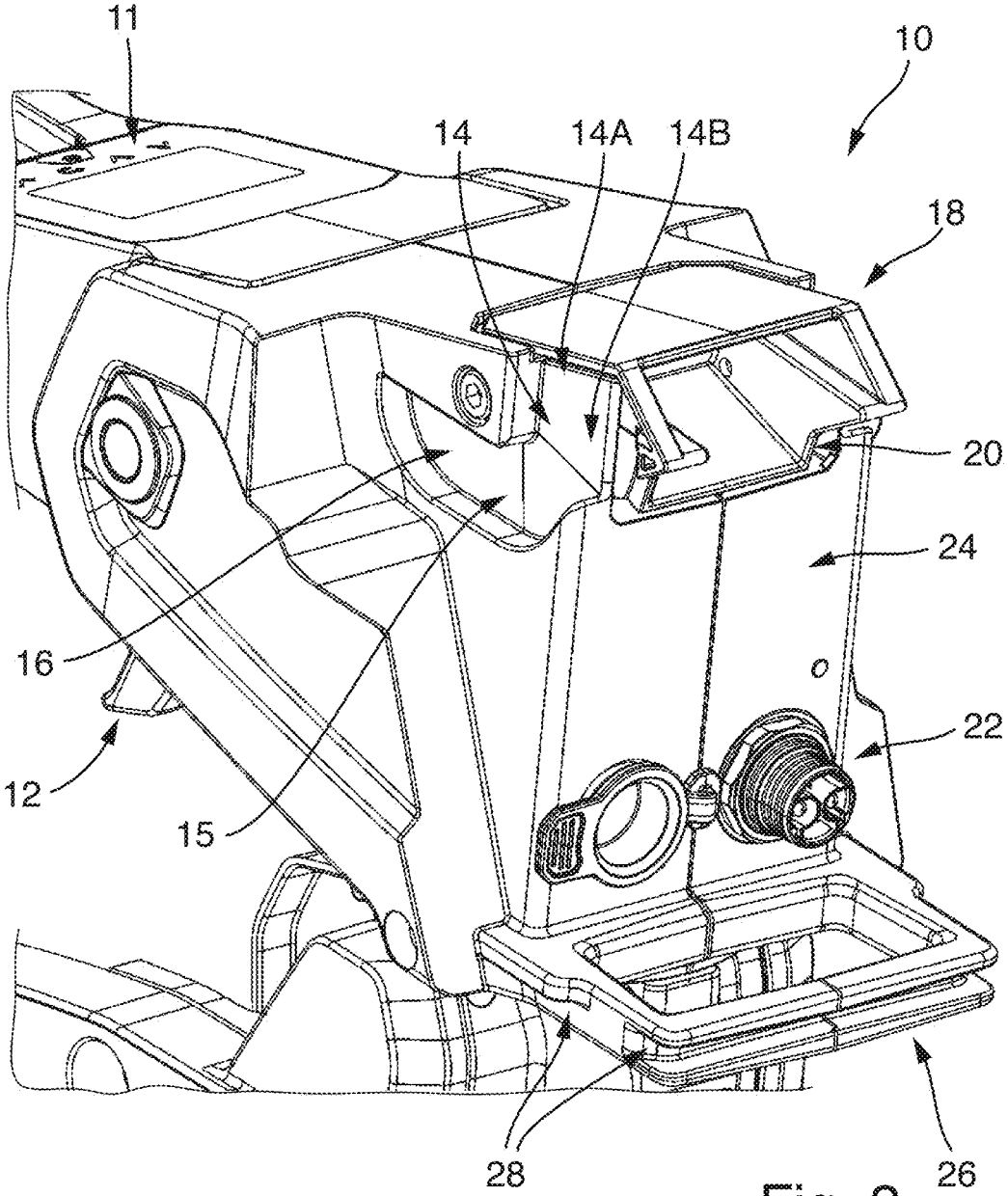
FIG. 2 shows a perspective illustration of the shaft head according to FIG. 1.

FIG. 2 shows a perspective illustration of the shaft head 10 according to FIG. 2. Here, the shaft head 10 is attached to an upper end of a shaft (not shown) and is connected to a pin 11 which serves for predefining the direction and for predefining the direction of rotation and the motor power of a propeller (not shown) which is attached to the lower end of the shaft. The propeller is attached, for example, to a propeller shaft which is driven by an electric motor which is arranged in a motor nacelle at the lower end of the shaft. Here, the pin 11 is secured on the shaft head 10 by a lock 12.

In FIG. 2, the guide 13 for receiving a housing of a battery is shown in more detail on the outer surface of the shaft head 10. Thus, it can be seen, inter alia, that the first connecting portion 14 is configured inclined with respect to the second connecting portion 16. As described above with regard to FIG. 1, the groove in the first connecting portion 14 is configured by two opposite walls, wherein the groove has an opening 14A at one end. The lower wall of the groove is not configured continuously here, but rather has an end-side cutout at the end region, wherein the opening 14B and the cutout jointly form a widening 14B or an enlarged end region of the groove. This opening 14A and widening 14B facilitate the insertion of a corresponding projection of the housing 32 of the battery 30.

In order to make possible an improved connection of the housing 32 of the battery 30 to the shaft head 10, the shaft head 10 furthermore has a lever 18, wherein the lever 18 is shown in the present case in a closed position and is preloaded into the closed position by an energy store, preferably a preloaded mechanical spring (not shown). A latching element of the lever 18 in this case is formed at least partially by an end-side chamfer 20. The chamfer 20 makes it possible for a movement of the lever 18 into an open position to be assisted during the connection of the housing 32 of the battery 30 or during the insertion of the housing 32, with the result that a connection to the shaft head 10 is facilitated by the second connecting section 16. The lever 18 is furthermore arranged in alignment with the outer surface, with the result that the lever 18 does not protrude from the outer surface and additionally has a corresponding cutout in order to facilitate an actuation of the lever 18.

During the connection of the housing 32 of the battery 30 to the shaft head 10, the housing 32 is moved in accordance with the battery in the direction of an end side 24 of the shaft head, wherein the pushing movement takes place linearly and perpendicularly to the longitudinal axis on account of the second connecting section 16, which extends away from the end side 24. As a result, the connection element 22 arranged on the end side 24 can be connected to a corresponding connection element on an end side of the housing of the battery and in particular can thus form a plug-in connection.

The perspective illustration according to FIG. 2 furthermore illustrates the optional holder 26 on the lower region of the shaft head 10 in an improved manner. Said holder furthermore makes it possible for the weight of the battery to be supported and not to be carried exclusively by the guide 13 or by the second connecting section 16. In the present example, the holder 26, which is of frame-shaped configuration, extends from the end side 24 of the shaft head 10 and has a groove 28 which, in the connected state, is in engagement with a base-side projection of the housing 32. In the present case, the groove 28 is divided into two regions spaced apart from one another, wherein a region adjacent to the end side 24 has an upper wall and an opposite end region has an upper wall and a lower wall spaced apart therefrom, wherein the walls are arranged at least partially circumferentially. Correspondingly, a connected housing 32 of a battery 30 can latch at the end region of the holder 26, and the housing 32 is mounted or held in both longitudinal directions by the holder 26.

Figure 3:
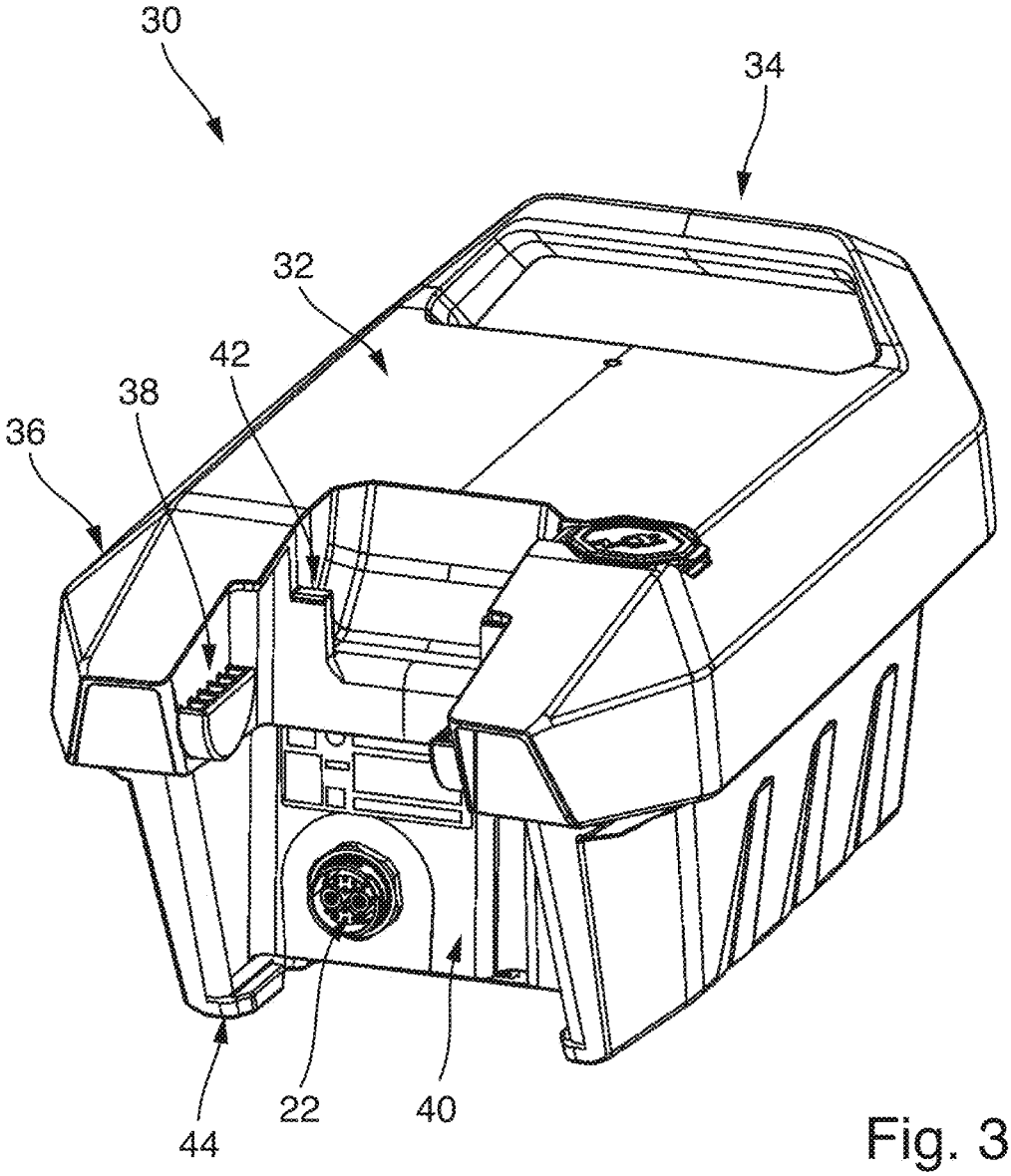
FIG. 3 shows a perspective illustration of the housing of the battery according to FIG. 1.

FIG. 3 shows a corresponding battery 30 of the outboard motor according to the present disclosure, wherein the housing 32 of the battery 30 is shown in more detail. A handle 34 for facilitating the handling and coupling or decoupling of the battery 30 is provided at an end region of the housing 32. At the opposite end of the housing 32, two connecting arms 36 extend from a corresponding end side 40, which connecting arms each have a guide element in the form of a projection 38. In the present case, the projections 38 are arranged on an inner surface of the respective arm 36, such that the projections 38 can be inserted into the outer groove of the shaft head or into the first connection portion 14, and the arms 36 in this case surround or receive the shaft head 10. In the present example, the projections 38 are of rounded or semicircular design, as a result of which the insertion into the first connection portion 14 and the initial pivoting movement for connecting the housing 32 or the battery 30 to the shaft head 10 are facilitated. Furthermore, the transition to the second connecting section 16 is also facilitated as a result.

When the housing 32 of the battery 30 is moved or pushed linearly with respect to the shaft head 10 by the second connecting section 16, the lever 18 can be preloaded into an open position on account of the chamfer 20 of the lever 18, which chamfer now touches an edge 42, with the result that the housing 32 can be fastened securely to the shaft head 10. For example, provision can be made for the projections 38 to be in engagement with an end region or a stop of the second connection section 16 after the linear displacement, wherein the projections 38 are held in a form-fitting manner by the respective groove on the basis of a corresponding geometry. Thus, the opposite end region of the second connection section 16 can have a rounding and dimensioning which is similar or substantially identical to the projections 38, with the result that the projections 38 can be held via corresponding contact surfaces. In order to prevent the projections 38 inadvertently moving linearly away from the respective end region, the latching element of the lever 18 preferably also has, in addition to the chamfer 20, an edge (not shown) which, in the connected state, adjoins the edge 42 and is held or delimited thereby in a direction perpendicular to the longitudinal axis.

The housing 32 of the battery 30 furthermore likewise has a connection element 22 on its end side 40, wherein the connection element 22 is arranged such that it forms a plug-in connection to the connection element 22 of the shaft head 10 on account of an advantageous concentric orientation during the linear displacement in the second connecting section 16. In this way, a reliable electrically conductive connection between the battery 30 and the shaft head 10 or to the pin 11 and a motor of the outboard motor can be provided without individual screw connections or connecting cables being required for this purpose.

Furthermore, a projection 44 is arranged on both sides on the base side of the housing 32, which projection is in engagement with the groove 28 of the shaft head 10 in the connected state of the housing 32 and thus provides further mounting of the housing 32 in addition to the guide 13.

Figure 4:
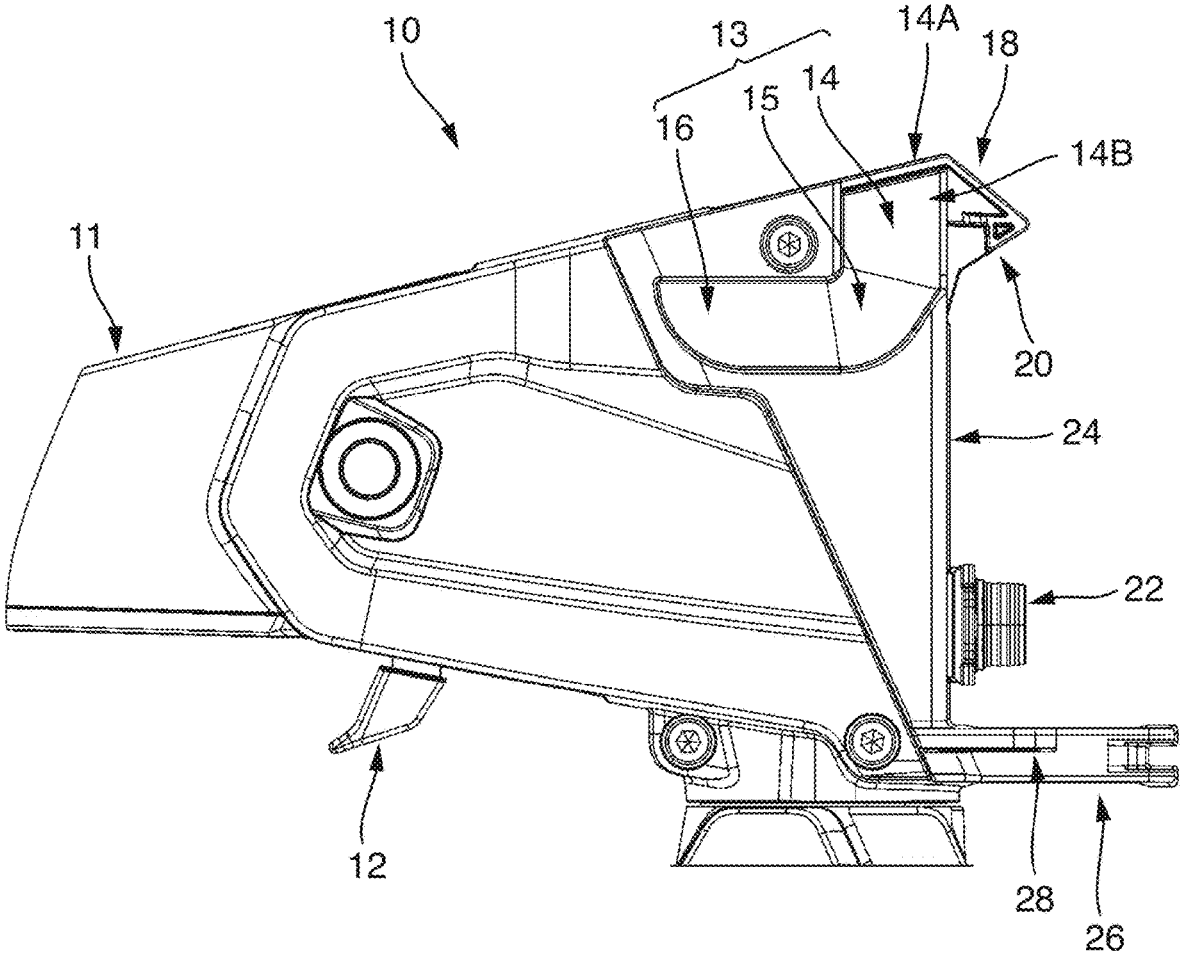
FIG. 4 shows the shaft head according to FIG. 1 in a side view.

In the side view according to FIG. 4, the extent of the guide 13 and the relative arrangement of the connection element 22 and the groove 28 of the holder 26 are likewise illustrated in an improved manner. Correspondingly, the guide 13 can preferably be of J-shaped (or alternatively L-shaped) configuration, wherein the shorter section forms the first connecting section 14, which is partially curved and configured inclined with respect to the second connecting section 16. Furthermore, it emerges clearly from said figure that the linear extent of the second connecting section 16 allows the linear plug-in connection of the connection elements 22 and the optional, additional mounting by the holder 26. In the connected state of the housing 32 of the battery 30, the end sides 24, 40 in this case can likewise adjoin one another, with the result that a very compact design without significant gaps or projections protruding from the outer surface is provided overall.

Figure 5:
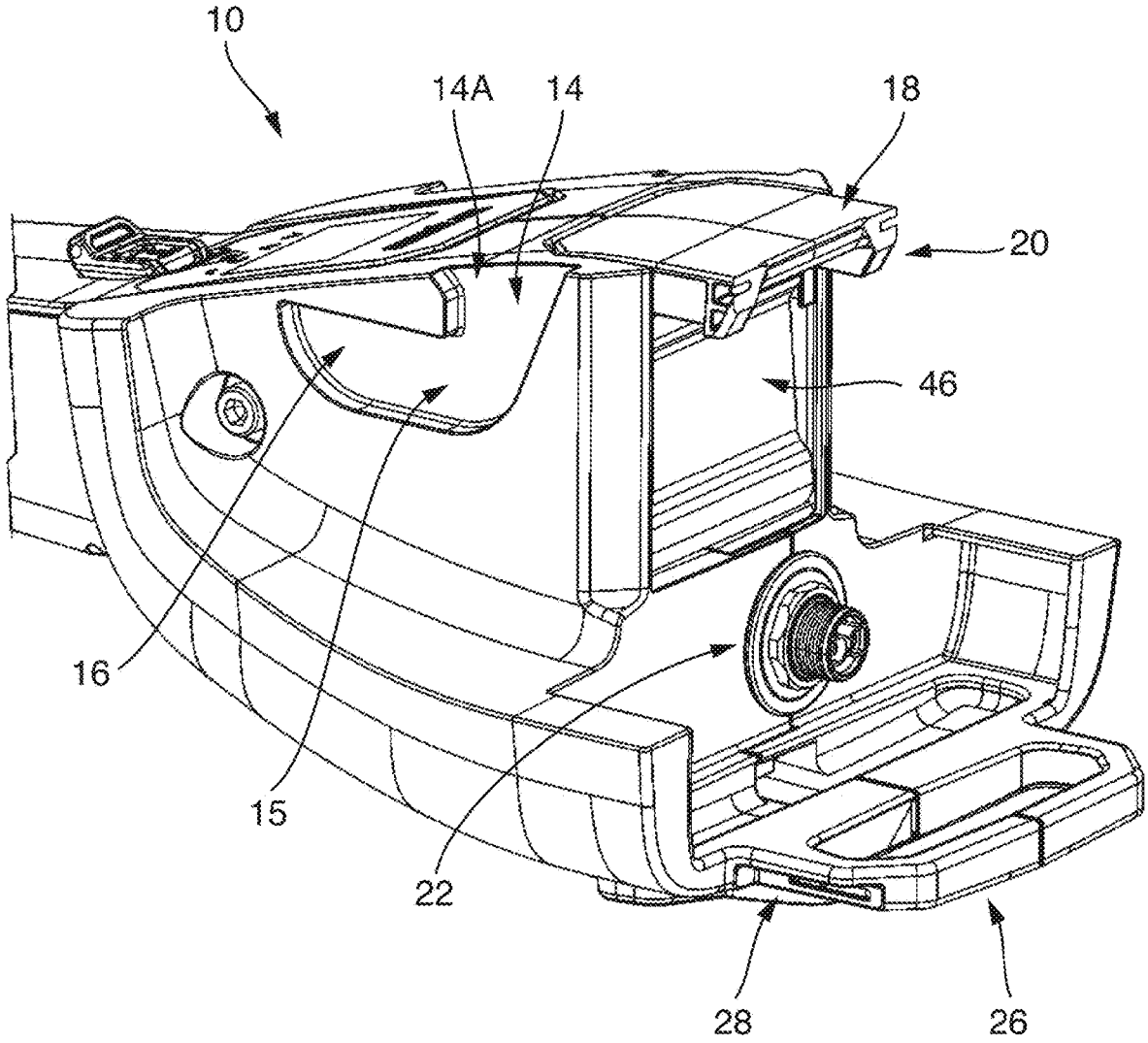
FIG. 5 shows a perspective illustration of a shaft head in an alternative embodiment.

An alternative or supplementary embodiment of the lever 18 is illustrated in the perspective illustration according to FIG. 5. In this example, it can be seen that the latching elements can have an optional chamfer 20, wherein said latching elements, together with a longitudinal edge connected thereto, form a hook shape. The longitudinal edge in this case can be in engagement with an adjoining edge of the housing 32, as described below with regard to FIGS. 6 to 8. Furthermore, the lever 18 has a lever arm 46 which is arranged on the end side in a corresponding receptacle on the outer surface and in such a way that, in the connected state of the housing 32 of the battery 30, said lever arm is in engagement with or makes contact with an end side 40 of the housing 32.

In order to enlarge the lever action, the guide 13 is arranged with an offset with respect to the end side 24, wherein the opening 14 A opens at an upper side of the shaft head 10. The opening 14 A in this case likewise forms a widening of the first connecting section 14, with the result that the end region of the first connecting section 14 is of virtually funnel-shaped or trapezoidal configuration. In this way, the insertion of the projections 38 on the housing 32 can likewise be facilitated.

Figure 6:
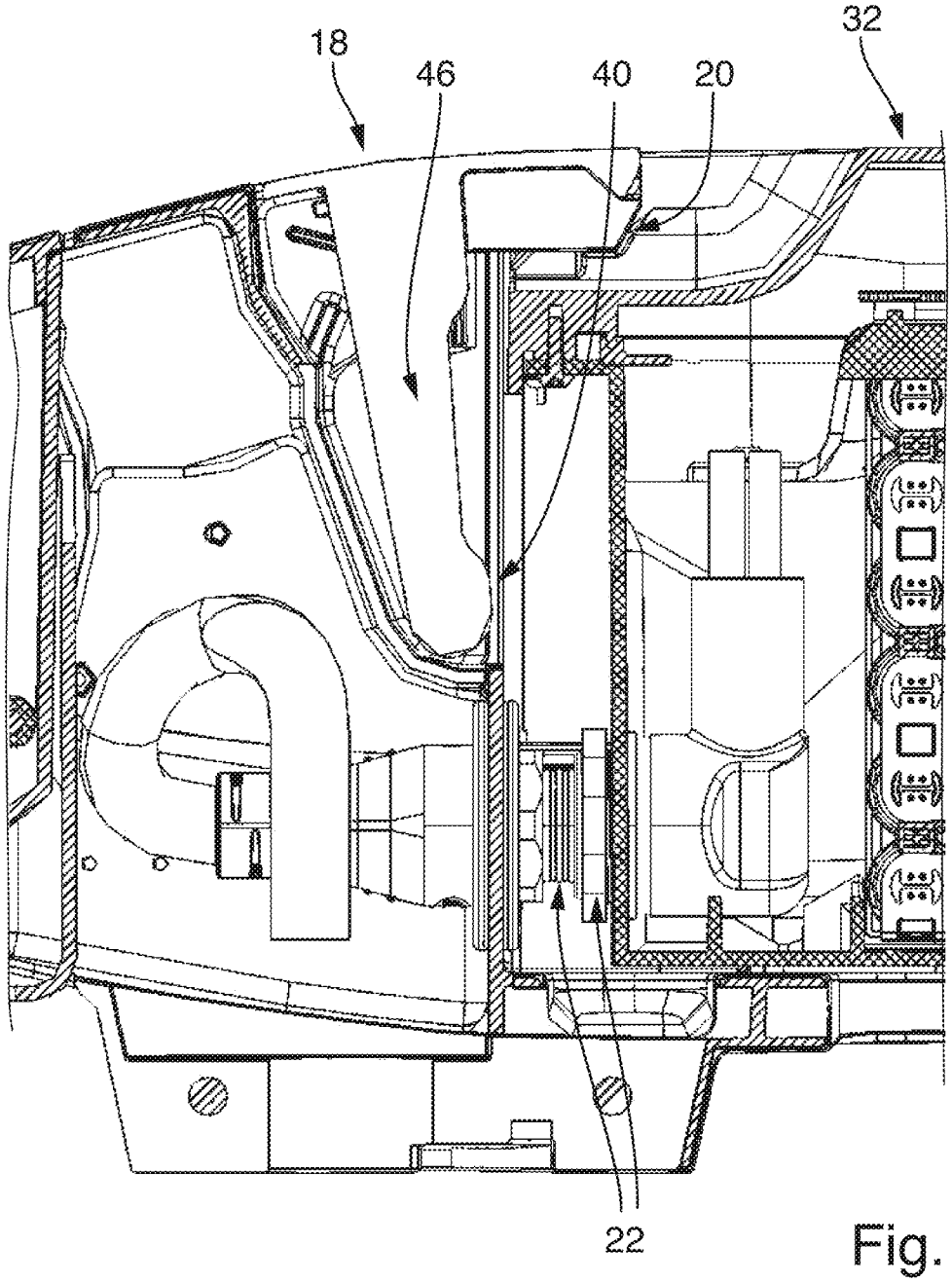
FIG. 6 shows a sectional illustration of an outboard motor having the shaft head according to FIG. 5 in the connected state to the housing of the battery.
Figure 7:
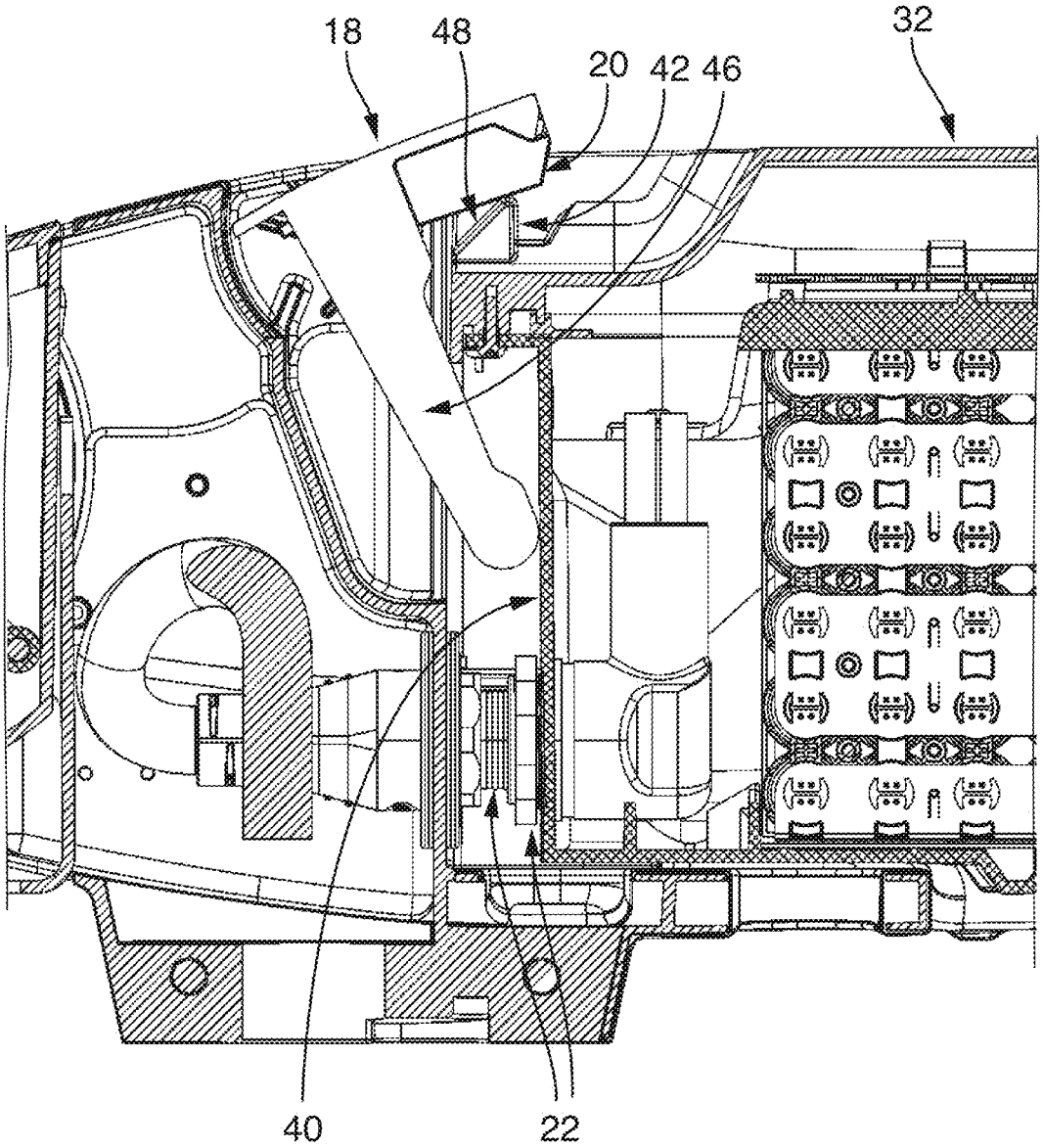
FIG. 7 shows a sectional illustration of the outboard motor according to FIG. 6 with an open lever position.
Figure 8:
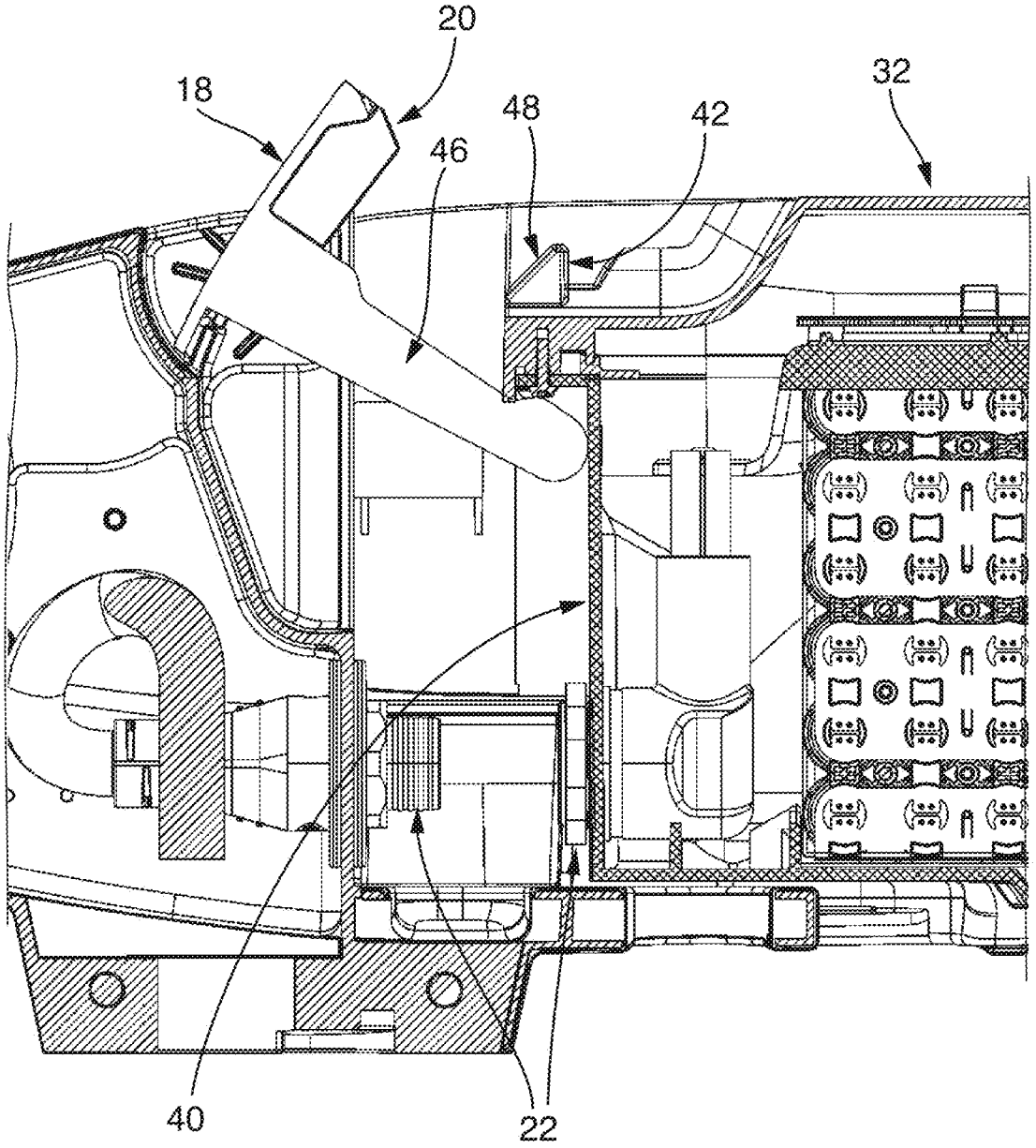
FIG. 8 shows a sectional illustration of the outboard motor according to FIG. 7 with a fully rotated lever position.

The contacting and mode of action of the lever arm 36 is shown in more detail in the sectional illustrations of FIGS. 6 to 8. In FIG. 6, the lever 18 is in this case in a closed position, wherein both the lever 18 and the lever arm 46 are received in a receptacle of the shaft head 10. The lever 18 in this case is configured in such a way that it is aligned with the outer surface of the shaft head 10 on the upper side, wherein, in addition to the chamfers 20, a small cutout is provided in order to facilitate an engagement into a cutout of the lever 18 for actuating the lever 18. When the lever 18 is actuated and is set into an open position, as shown in FIG. 7, the housing 32 is pushed away from the shaft head 10 within the guide 13 on account of the contacting of the end side 40 with the lever arm 46, wherein the rotation and the corresponding torque bring about a linear translation of the housing 32. In this figure, the edge 42 can also be seen which, in the connected state and in the closed position of the lever 18, is in engagement with the longitudinal edge on the chamfer 20 of the hook-shaped latching element, as illustrated in FIGS. 5 and 6. The edge 42 is likewise illustrated predominantly with an optional chamfer 48 which, in the event of a linear pushing movement of the housing 32 in the direction of the shaft head 10, allows a sliding against one another with the chamfer 20 and optionally a preloading into the open position of the lever 18.

In the case of a fully rotated lever position, as illustrated in FIG. 8, the projections 38 are located in the transition region 15 of the first and second connecting sections 14, 16, with the result that the battery 30 can be rotated out of the first connecting section 14 by a handle 34 on the housing 32 and can be separated or decoupled from the shaft head 10. It can also be seen here that the linear translation allows a virtually automatic separation of the connection elements 22, with the result that the plug-in connection of the connection elements 22, which plug-in connection is shown in FIG. 6, can be released in a reliable and predefined manner. Correspondingly, decoupling of individual screw connections and also pushing out of a mechanical locking bolt can be dispensed with on account of the advantageous configuration of the guides 13 and the corresponding arrangement of the connection elements 22 and of the provided lever 18.

Figure 9:
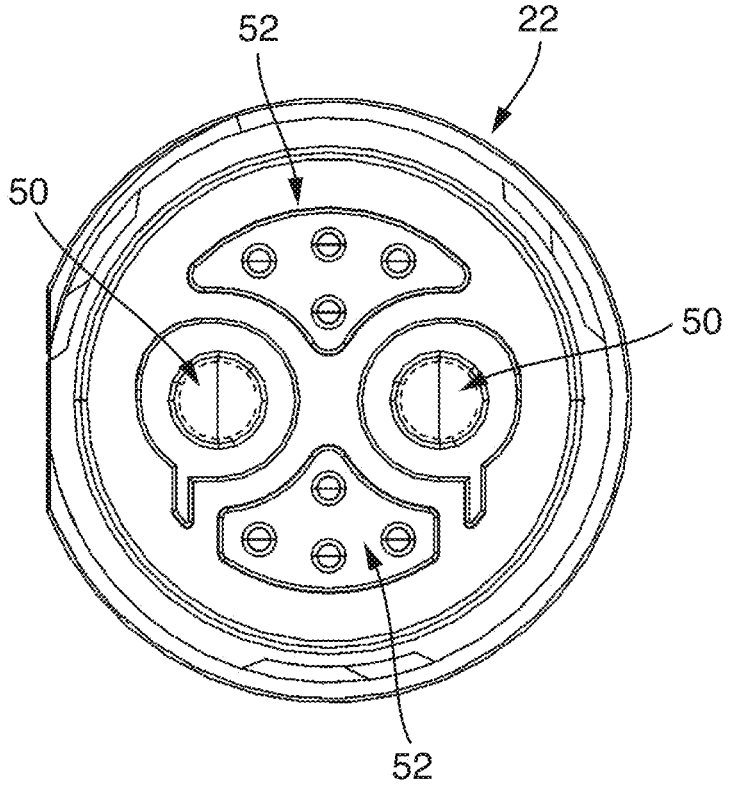
FIG. 9 shows a plan view of a connection element with different contact regions.

An example of an advantageous configuration of a connection element 22 is illustrated in a plan view in FIG. 9. Correspondingly, the connection element 22 can be designed as a socket or plug and have different contact regions which are insulated from one another. Thus, a contact region 50 can be provided for a motor connection of the outboard motor and can be designed in particular in the form of two receptacles for a respective contact pin or contact pin if the connection element 22 is designed as a socket, while the corresponding contact region for a plug unit is designed as corresponding contact pins. Likewise, two contact regions 52 are provided for a multiplicity of contact pins, in the present case in each case four, wherein these contact regions 52 are provided for connecting the battery 30 to the pin 11. Correspondingly, for example, a power controller can be provided via the contact regions 52.

To the extent applicable, all individual features which are illustrated in the exemplary embodiments can be combined with one another and/or exchanged without departing from the scope of the exemplary embodiments of the present disclosure.

REFERENCE SYMBOL LIST

10 shaft head
11 pin
12 locking
13 guide
14 First connecting section
14A opening
14B widening
15 transition region
16 Second connecting section
18 lever
20 chamfer
22 Connection element
24 end side
26 holder
28 groove
30 battery
32 housing
34 handle
36 arm
38 projection
40 end side
42 edge
44 projection
46 lever arm
48 chamfer
50 motor contact region
52 pin contact region

What is claimed:

1. An outboard motor comprising:

a shaft head defining a longitudinal axis; and a housing of a battery that is detachably connectable to the shaft head, wherein the shaft head has a plurality of guides configured to connect the housing of the battery, wherein guide elements extend at an end region of the housing and are arranged such that the guide elements engage with a respective guide of the plurality of guides when connecting the housing to the shaft head, wherein the plurality of guides and the guide elements are configured such that the housing is first pivoted on the shaft head and subsequently pushed relative to the shaft head, and wherein the housing and the shaft head each have an electrical connection element that is arranged such that the housing and the shaft head are electrically conductively connected to one another by a pushing movement when connecting the housing to the shaft head.

2. The outboard motor according to claim 1, wherein the connection elements are each arranged on the end side and spaced apart from one another during a pivoting movement and are aligned concentrically with respect to one another during the pushing movement.

3. The outboard motor according to claim 1, wherein an end side of the shaft head and an end side of the housing each have a single electrical connection element that provides an electrically conductive connection for a pin and motor connectable to the shaft head.

4. The outboard motor according to claim 1, wherein the plurality of guides are arranged on mutually opposite sides of an outer surface of the shaft head and define a first connecting section and an adjacent second connecting section for the guide elements, and wherein the second connecting section extends perpendicularly to the longitudinal axis and linearly and the first connecting section is inclined with respect to the second connecting section.

5. The outboard motor according to claim 4, wherein the first connecting section is configured for pivotable mounting of the housing and the second connecting section is configured for slidable mounting of the housing.

6. The outboard motor according to claim 4, wherein the respective guide is configured as a groove and the respective guide element is configured as a projection, and wherein the respective groove has an opening and/or a widening at the end region of the first connecting section that is opposite the second connecting section for insertion of the respective projection.

7. The outboard motor according to claim 4, wherein the first connecting section is of non-linear or curvilinear configuration.

8. The outboard motor according to claim 4, wherein the inclination of the first connecting section with respect to the longitudinal axis lies in an angular range between 10° and 80°.

9. The outboard motor according to claim 4, wherein the respective guide element is of rounded or arcuate configuration, and the respective guide is rounded in a transition region of the first and second connecting sections.

10. The outboard motor according to claim 1, wherein the respective guide is L-shaped or J-shaped.

11. The outboard motor according to claim 1, wherein the respective guide and the respective guide element are configured such that the housing of the battery is connectable to the shaft head exclusively in a single predefined orientation relative to the shaft head.

12. The outboard motor according to claim 1, wherein the respective guide and the respective guide element are configured such that, in a connected state of the housing, the respective guide element forms two line contacts spaced apart from one another or at least one contact surface with the respective guide.

13. The outboard motor according to claim 1, wherein the respective guide and the respective guide element are configured such that, in a connected state of the housing, the respective guide element is held in a form-fitting manner by the respective guide.

14. The outboard motor according claim 1, further comprising:

two arms spaced apart laterally from one another extend at the end region of the housing, wherein the guide elements are arranged on a respective arm of the two arms, and wherein the two arms of the outer housing are configured such in such a way that, in a connected state with the housing, the shaft head is at least partially enclosed by the housing or is at least partially received in the housing.

15. The outboard motor according claim 1, wherein an outer surface on an end side of the shaft head has, in a cross section, a contour that is inclined relative to the longitudinal axis and that at least partially corresponds to a contour of an adjacent end side of the housing in the connected state.

16. The outboard motor according to claim 1, wherein the shaft head comprises a frame-shaped or plate-shaped holder that extends from an outer surface thereof and that is arranged such that, in a connected state, a base section of the housing is at least partially mounted by the holder.

17. The outboard motor according to claim 16, wherein the holder at least partially has a groove on opposite sides, the groove being configured such that, in the connected state, the groove engages with a respective base-side projection of the housing that is delimited by the holder in at least one direction along the longitudinal axis.

18. The outboard motor according claim 1, wherein:

the shaft head comprises a rotatably mounted lever that is preloaded into a closed position by an energy store, and the lever comprises at least one latching element that, in a connected state and in the closed position of the lever, engages with an edge, which extends in the longitudinal direction, on the housing such that the housing is delimited in a direction perpendicular to the longitudinal direction.

19. The outboard motor according to claim 18, wherein the latching element and the edge have a respective chamfer that is each arranged such that, during a connecting of the housing to the shaft head, the respective chamfers adjoin one another at least in sections during a pushing movement and preload the lever into an open position and/or, in a connected state, are spaced apart from one another in a direction perpendicular to the longitudinal direction.

20. The outboard motor according to claim 18, wherein the lever has a lever arm that extends in the longitudinal direction from the lever, and, in the connected state, the lever arm engages with an end side of the housing and is torque-coupled to the lever.

* * * * *